United States Patent [19]

Ferguson

[11] 4,437,088

[45] Mar. 13, 1984

[54] ELECTRICAL SIMULATION OF PERCUSSIVE BELL

[75] Inventor: Harry D. Ferguson, Owen Sound, Canada

[73] Assignee: General Signal Corporation, Stamford, Conn.

[21] Appl. No.: 323,520

[22] Filed: Nov. 19, 1981

[51] Int. Cl.[3] ..... G08B 1/00

[52] U.S. Cl. ..... 340/384 E; 340/384 R

[58] Field of Search ..... 340/384 E, 384 R; 179/84 T; 331/47, 76, 173; 84/1.13, 1.22, 1.23, 1.24

[56] References Cited

U.S. PATENT DOCUMENTS

| | | | |
|---|---|---|---|
| 3,587,094 | 6/1971 | Scott | 340/384 E |
| 4,001,816 | 1/1977 | Yamada et al. | 340/384 R |
| 4,183,278 | 1/1980 | Rea et al. | 340/384 R |
| 4,198,891 | 4/1980 | Weber | 84/1.22 |
| 4,215,339 | 7/1980 | Durkee | 340/384 E |

*Primary Examiner*—Gerald L. Brigance

*Attorney, Agent, or Firm*—Milton E. Kleinman; Ronald Reichman

[57] ABSTRACT

An electronic circuit for simulating the sound of a percussive bell struck at a predetermined repetition rate. A realistic electronically generated sound is produced by appropriately modulating two or more audio frequencies with a decaying exponential control signal and thereafter mixing the modulated frequencies. The system comprises a repetition rate generator; a modulation envelope generator; a high and low frequency oscillator; a modulator; and a mixer together with a loud speaker. The repetition rate generator determines the ringing frequency of the simulated bell sound. The modulation envelope generator generates two decaying control signals with differing time constants with the time constant of the low frequency generator usually being greater than the time constant of the high frequency generator. Filter networks may be used to eliminate some of the harmonics. Potentiometers may be provided to vary the magnitude of the low and high frequency components at the input to the mixer. An isolation transformer may be used and connected to an external amplifier for audio distribution of the electronically generated sound.

18 Claims, 2 Drawing Figures

111A
112A
AUDIO AMP.
MIXER AMP.
MODULATION ENVELOPE GENERATOR
LOW FREQ. DECAY
HI FREQ. DECAY
MULTIPLIER XY/10
MULTIPLIER XY/10
FILTER
ASTABLE MULTI-VIBRATOR 20 STM
800 HZ OSCILLATOR SQUARE WAVE GENERATOR
3200 HZ OSCILLATOR SINE WAVE GENERATOR
100
101
102
103
106
107
108
111
112
113
116
117
121
122
123
126
127
131
132
133
134
136
137
138
139
140
141
142
146
148
149
X
Y

ELECTRICAL SIMULATION OF PERCUSSIVE BELL

BACKGROUND OF THE INVENTION

Edgar Alan Poe, in his poem entitled "The Bells", enumerated many ways in which bells may be used to indicate a wide variety of conditions and events. Poe contemplated principally the wide variety of bells which were struck with a clapper. Currently, the generic term "bells" also includes a wide variety of electrically operated devices, one of the most ubiquitous of which is the ordinary household doorbell comprising a gong which is repetitively struck in response to the actuation of an electromagnet. With the advance in technology, bell tones have been amplified and gongs and strikers have been designed to produce a wide variety of tones and sounds. In addition, electronic techniques have been used to generate a wide variety of other audible alarm signals. Police and/or ambulance sirens, as used in many municipalities, are typical and offer various advantages in sound volume, ruggedness, economy and reliability.

Because of the generations of use of percussive bell signals and our familiarity with and acceptance of their sound, there are still many applications wherein it is considered desirable to use percussive bells. However, percussive bells and their associated electromechanical striker mechanisms have a tendency to be unreliable and/or require routine adjustment and/or maintenance. In addition, these traditional devices tend to be bulkier and more expensive than electronic sound generation. Accordingly, in order to provide traditional bell tones and electronic economy and reliability, efforts have been made to reproduce bell sounds electronically. For the most part, such devices have merely imitated bell sounds and have included a wrong mix of harmonics to simulate authentic sounds. Other techniques have required such extensive and elaborate circuitry as to render them uneconomic except in highly specialized applications.

Examples of these prior art devices may be seen in the following patents.

U.S. Pat. No. 2,354,699 issued Aug. 1, 1944 to E. L. Owens is a pertinent patent in that it teaches generation of voltages of the more important frequencies of the desired tones and the blocking of an amplifier with a decaying signal characteristic of percussion type signals.

U.S. Pat. No. 3,325,578 issued June 13, 1967 to D. M. Park teaches the use of two tuned circuits which produce frequencies which are not harmonically related. A triggering pulse source causes damped oscillations in the tuned circuits and exponentially decaying sound for simulating a cow bell.

U.S. Pat. No. 3,460,136 issued Aug. 5, 1969 to V. M. Jambazian provides a device in which two signals of different frequencies are operated on to produce an output providing characteristics similar to the sound produced by birds and the like.

U.S. Pat. Nos. 3,218,636 and 3,742,492 issued Nov. 16, 1965 and June 26, 1973 to J. M. Bernstein et al and D. F. Proctor, respectively, disclose techniques for producing sounds electronically and use piezoelectric devices.

U.S. Pat. No. 2,455,472 issued Dec. 7, 1948 to H. C. Curl et al discloses a means for the selective generation of selected complex tones by frequency modulation to produce signals having a large number of frequency components.

U.S. Pat. Nos. 3,249,933 and 4,092,893 issued May 3, 1966 and June 6, 1978 to R. W. McKee and R. O. Beach, respectively, teach sound generation through amplifiers after striking a vibrating member.

U.S. Pat. No. 3,587,094 issued June 22, 1971 to R. Scott teaches a generation of a variety of sounds through the use of random voltage generators, voltage controlled tone generators, pulsers, triggers, pulse shapers, keyers, audio generators, delay devices, amplifiers and loud speakers.

U.S. Pat. No. 4,180,808 issued Dec. 25, 1979 to J. P. Lebet et al discloses another system using a piezoelectric transducer together with a means for controlling the applied potential.

SUMMARY OF THE INVENTION

The sound of a percussive bell is electronically simulated through the use of five major elements. The first comprises a repetition rate generator which is a standard astable multivibrator running at a fixed frequency. This fixed frequency, which may be adjusted to any predetermined value, determines the ringing frequency of the bell sound. There is also a low frequency and high frequency oscillator each comprising a standard oscillator circuit. There is a modulation envelope generator which generates two decaying control signals each with a different time constant. The time constant for the low frequency modulation control signal is greater than the time constant for the high frequency signal. The output of the low frequency multivibrator is filtered to eliminate some of the harmonics in the square wave which has been generated. The output of the filter is capacitively coupled to a modulator whose output is equal to a function of the product of the oscillator input and the modulation control signal. The output of the high frequency oscillator is applied to another modulator whose output is equal to a function of the product of the oscillator input and the high frequency modulation control signal. The output of each modulator circuit is capacitively coupled to the input of a mixer amplifier whose output may be connected to suitable audio distribution means including, as may be required, an isolation transformer, an audio amplifier and a plurality of loud speakers.

It is an object of this invention to provide a new and improved electronic circuit for simulating the sound of a percussive bell.

It is a more specific object of the invention to provide a circuit of the character described which more faithfully simulates the sound of a percussive bell.

It is another object of the invention to produce a circuit of the character described which is economical and reliable.

It is another object of the invention to provide an electronic means for simulating a percussive bell sound with an apparatus which does not require any mechanical adjustments.

BRIEF DESCRIPTION OF THE DRAWING

To permit an incisive and detailed analysis of the principles and operational characteristics of the invention, the principles thereof are disclosed in a single figure comprising a block diagram of the components disclosing the concept. The block diagram is intended to disclose the general principles of the invention and is not meant, in any way, to delimit its scope. It is rather so drawn as an aid in understanding the invention without the inclusion of detailed circuit elements which would only tend to obscure the concepts. In the drawing.

DESCRIPTION OF THE PREFERRED EMBODIMENT

Figures 1, 2:
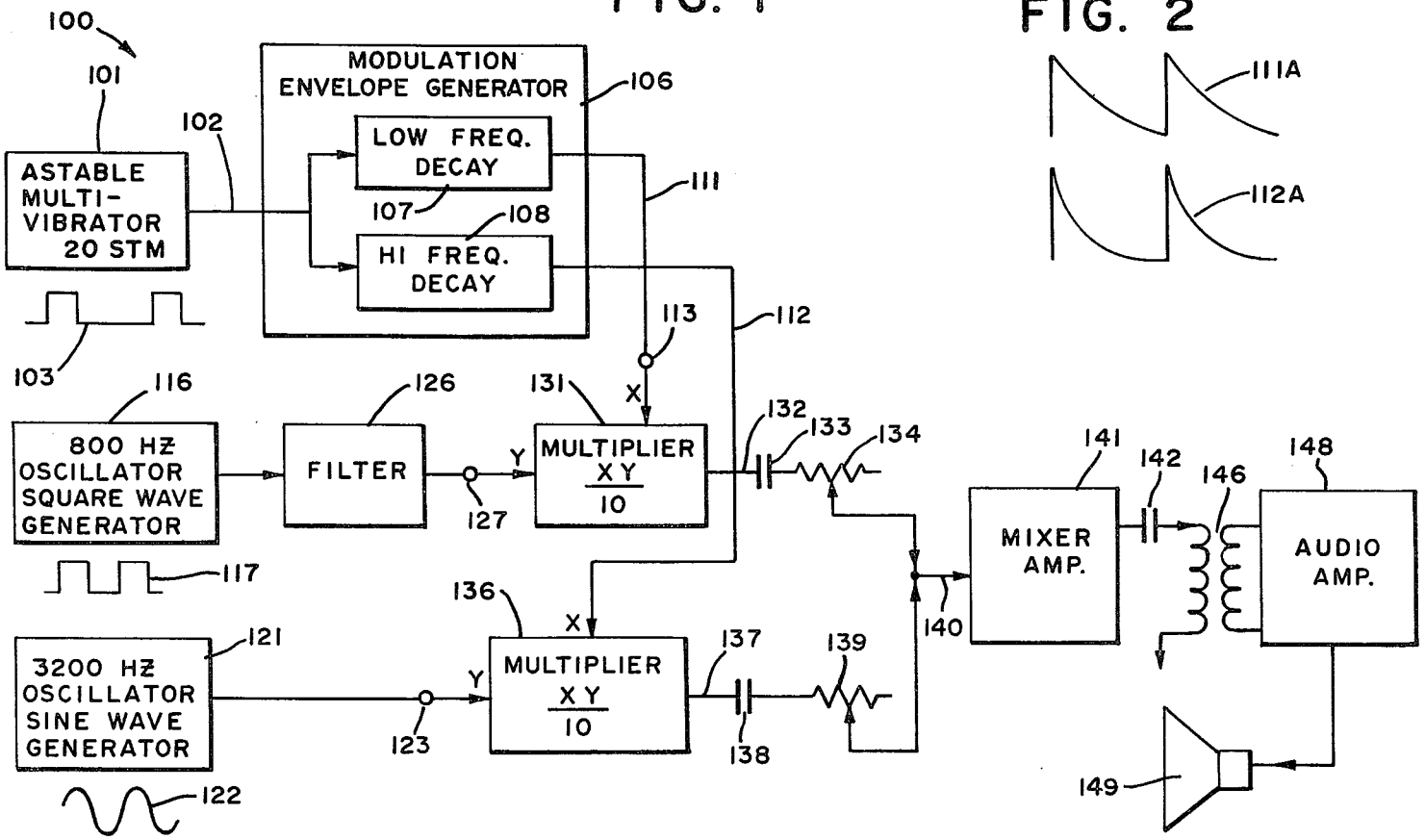
FIG. 1 comprises a block diagram of the principal components of the invention.
FIG. 2 illustrates the relative shape of the time constants of two circuits.

Considering now more specifically FIG. 1, there will be seen therein a block diagram of the major components comprising the electronic means for simulating the sound of a percussive bell. The circuit is indicated generally as 100. The electronic bell comprises an astable multivibrator 101 which may produce a square wave output signal of a predetermined frequency generally falling within the range of a few strokes per minute to a few hundred strokes per minute. That is, the astable multivibrator 101 produces a square wave signal at a frequency corresponding to the pulse repetition rate of the bell which is to be electronically simulated and the pulse repetition rate of such bells generally fall within the range of a few strokes per minute such as approximately five or twenty to a few hundred strokes per minute such as two or three hundred to perhaps five or six hundred strokes per minute. The astable multivibrator 101 is illustrated as comprising a twenty stroke per minute multivibrator. However, it should be understood that it may be modified to produce any desired output frequency. The output of the astable multivibrator 101 appears on lead 102 and is applied to a modulation envelope generator 106. Which is in turn seen to comprise a low frequency decay circuit 107 and a high frequency decay circuit 108. The low frequency decay circuit 107 and the high frequency decay circuit 108 each generate an individual decaying control signal each with a different time constant. The time constant for the low frequency modulation control signal derived from the low frequency decay circuit 107 is longer than the time constant for the high frequency modulation control signal derived from the high frequency decay circuit 108. The relative shapes of the decaying control signals from the low frequency decay circuit 107 and the high frequency decay circuit 108 are illustrated in FIG. 2 as curves 109 and 110, respectively. The low frequency decaying control circuit and the high frequency decaying control circuit is applied to leads 111 and 112, respectively.

The electronic bell also includes two oscillators 116 and 121, one of which generates a signal frequency of the order of 800 Hertz while the other generates a signal frequency of the order of 3200 Hertz. It should be understood that the cited frequencies are illustrative and that other suitable frequencies could be used. The 800 Hertz oscillator 116 produces a square wave output signal as indicated by the sketch 117 and the 3200 Hertz oscillator 121 produces a sine wave output as indicated by 122. The square wave output of the 800 Hertz oscillator 116 is applied as an input to filter 126 to eliminate some of the harmonics in the square wave 117. The filtered output of the oscillator 116 and the sine wave output of the oscillator 121 are applied to modulators such as the multipliers 131 and 136, respectively. It will be seen that the output of the low frequency decay circuit 107 is applied on lead 111 as another input to the multiplier 131 and that the output of the high frequency decay circuit 108 is applied on lead 112 as another input to the multiplier 136. The multipliers 131 and 136 produce outputs on their respective output leads 132 and 137, each of which is a function of the product of the two inputs, in the illustrated case 10% of the product. The output signal of multiplier 131 on lead 132 passes through capacitor 133 and adjustable potentiometer 134 to input lead 140 to the mixer 141. In a similar manner, the output of multiplier 136 on lead 137 passes through capacitor 138 and potentiometer 139 to input lead 140 to the mixer 141. The potentiometers 134 and 139 are provided to vary the relative proportions of the low frequency and high frequency components at the input to the mixer amplifier 141.

The output of the mixer amplifier 141 is capactively coupled through capacitor 142 to an optional isolation transformer 146 to provide system isolation and for grounding if desired. The transformer output is coupled to an external audio amplifier 148 which in turn provides an input signal to one or more loud speakers 149.

In order to maximize the realistic simulation of a percussive bell tone, it is desirable to provide certain adjustments with respect to some circuits and to perform a series of tests. In order to test that the 800 Hertz oscillator 116 is providing the desired frequency, test equipment may be connected to test point 127 and components of the circuit 116 adjusted until the desired frequency is read at test point 127. Oscillators and techniques for adjusting their frequency are well-known in the art and therefore, specific details of the oscillator 116 and the means for frequency adjustment are not shown in FIG. 1 as such detail would tend to obscure the novel aspects of this invention. In a similar manner, the 3200 Hertz oscillator 121 may be tested by connecting appropriate test equipment at test point 123 and adjusting the oscillator 121 until the desired frequency is obtained at test point 123. Other test points such as test point 113 may be provided as convenient and expedient to facilitate assembly and installation testing and adjustment.

Those familiar with the wide variety of integrated circuits currently available, will understand that the adjustable multivibrator 101, the 800 Hertz oscillator 116, the 3200 Hertz oscillator 121, the multipliers 131 and 136, the mixer amplifier 141 and other components could comprise standard integrated circuit chips with a variety of potentiometers, capacitors and resistors connected between various terminals thereof for control purposes. The filter 126 may comprise a conventional resistor capacitor filter network.

While there has been shown and described what is considered at present to be a preferred embodiment of the invention, modifications thereto will readily occur to those skilled in the related arts. For example, in another structure the ratio of frequencies could vary and other time constants could be used. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. An electronic bell which produces a signal which sounds like a standard electromechanical bell comprising in combination:

(a) a rate generator for producing an output signal at a predetermined stroke rate that determines the ringing frequency of the bell sound;

(b) a modulation envelope generator for producing a low frequency and a high frequency decaying exponential control signal in response to signals from said rate generator wherein said low frequency signal has a first time constant and said high frequency control signal has a second time constant, said first time constant being longer than said second time constant;

(c) first and second audio frequency generators of first and second frequencies, respectively;

(d) first and second modulating means coupled to said first and second audio frequency generators and said first and second decaying exponential control signals, respectively, for producing first and second signals comprising modulations of said first and second audio frequencies, respectively;

(e) mixing means coupled to said first and second modulated output signals for mixing the same; and (f) a loudspeaker and coupling means coupling said mixed audio frequencies to said loudspeaker for producing an audible sound characteristic of a vibrating bell struck at the frequency of said rate generator.

2. The combination as set forth in claim 1 wherein said rate generator may provide a signal frequency ranging from a few to a few hundred cycles per minute.

3. The combination as set forth in claim 2 wherein said first and second audio frequency generators generate signals wherein said second frequency is of the order of 3 to 6 times that of said first frequency.

4. The combination as set forth in claim 3 wherein said first and second audio frequency signals approximate square waves and sine waves, respectively.

5. The combination as set forth in claim 4 and including a filter between said first audio frequency generator and said first modulating means for eliminating some of the harmonics in said first audio frequency.

6. The combination as set forth in claim 5 wherein said first and second modulated output signals are each coupled to said mixing means via a respective capacitor and potentoimeter for varying the magnitude of the low and high frequency components coupled as an input to said mixer.

7. The combination as set forth in claim 6 wherein said coupling means between said mixed audio frequencies and said loudspeaker includes capacitive coupling and an isolation transformer.

8. The combination as set forth in claim 7 and including an amplifier between said isolation transformer and said loudspeaker.

9. The combination as set forth in claim 1 wherein said first audio frequency generator has a frequency of approximately 800 Hertz and said second audio frequency generator has a frequency of approximately 3200 Hertz.

10. A solid state circuit for generating signals to simulate the sound of a percussive bell struck at a predetermined repetition rate and comprising in combination:

(a) an astable multivibrator for producing a square wave output at said repetition rate;

(b) first and second oscillators for producing signals at first and second frequencies, respectively, which approximately correspond with harmonics of the percussive bell to be simulated and with said first frequency being less than said second frequency;

(c) a modulation envelope generator coupled to said multivibrator for producing a low frequency decaying exponential control signal having a first time constant and a high frequency decaying exponential control signal having a second time constant, wherein said first time constant is longer than said second time constant;

(d) first and second modulation means with said first modulation means receiving input signals from said first oscillator and said first control signal and with said second modulation means receiving input signals from said second oscillator and said second control signal and with said first and second modulation means producing first and second output signals, respectively, in response to their respective input signals; and (e) mixing means coupled to said first and second output signals for mixing said first and second output signals and producing a simulation signal which, in response to application to suitable audio means, simulates a percussive bell sound.

11. The combination as set forth in claim 10 and including filter means between said first oscillator and said first modulator for eliminating some of the harmonics in the output of said first oscillator.

12. The combination as set forth in claim 10 wherein said first oscillator produces a square wave output.

13. The combination as set forth in claim 10 wherein said second oscillator produces a sine wave output.

14. The combination as set forth in claim 10 wherein said first and second output signals each comprise a function of the product of the inputs to their respective modulation means.

15. The combination as set forth in claim 10 wherein said first and second frequencies are within the audio range.

16. The combination as set forth in claim 15 wherein said second frequency is within the range of 2 or 3 to 6 or 8 times said first frequency.

17. The combination as set forth in claim 10 wherein said repetition rate may be within a range of a few to a few hundred cycles per minute.

18. The combination as set forth in claim 10 and including adjusting means between said mixing means and said first and second output signals for adjusting the relative magnitudes of said first and second output signals applied to said mixing means.

* * * * *